United States Patent [19]

Daughters

[11] 4,400,103

[45] * Aug. 23, 1983

[54] UNIVERSAL RIBBON CARTRIDGE

[75] Inventor: James R. Daughters, Danville, Calif.

[73] Assignee: Wordex, San Leandro, Calif.

[ * ] Notice: The portion of the term of this patent subsequent to Dec. 29, 1998 has been disclaimed.

[21] Appl. No.: 232,598

[22] Filed: Feb. 9, 1981

Related U.S. Application Data

[63] Continuation-in-part of Ser. No. 80,880, Oct. 1, 1979, Pat. No. 4,307,969.

[51] Int. Cl.[3] ..... B41J 33/14

[52] U.S. Cl. ..... 400/208; 400/235.1; 400/243

[58] Field of Search ..... 400/194, 195, 196, 196.1, 400/207, 208, 208.1, 229, 234, 235.1, 236, 243

[56] References Cited

U.S. PATENT DOCUMENTS

| | | | |
|---|---|---|---|
| 3,349,887 | 10/1967 | Goff, Jr. | 400/208 |
| 3,904,018 | 9/1975 | Denley | 400/229 X |
| 3,918,569 | 11/1975 | Parker | 400/229 X |
| 4,079,827 | 3/1978 | Work | 400/229 X |
| 4,091,913 | 5/1978 | Ku et al. | 400/196.1 X |
| 4,132,485 | 1/1979 | Hess | 400/208 |
| 4,231,667 | 11/1980 | Behrendt et al. | 400/208 |
| 4,307,969 | 12/1981 | Daughters | 400/208 |

*Primary Examiner*—Ernest T. Wright, Jr.
*Attorney, Agent, or Firm*—Townsend and Townsend

[57] ABSTRACT

A cartridge for accommodating a daisy wheel type printer includes a supply spool for holding a fresh supply of ribbon and a take-up spool for holding used ribbon. The cartridge includes two arms which define a path for the ribbon to pass between the paper and the printer mechanism. In one embodiment, two drive gears are serially engaged with each other and with a ribbon drive wheel. When the first drive gear is driven by a drive shaft of the printer, the direction of ribbon advance is the same as that of the rotation of the drive shaft. When the second gear is driven, the rotational direction of the ribbon advance is opposite that of the drive shaft. In an alternate embodiment, a ribbon drive gear is mounted on a common shaft with the first drive gear and biased against a single idler wheel.

8 Claims, 14 Drawing Figures

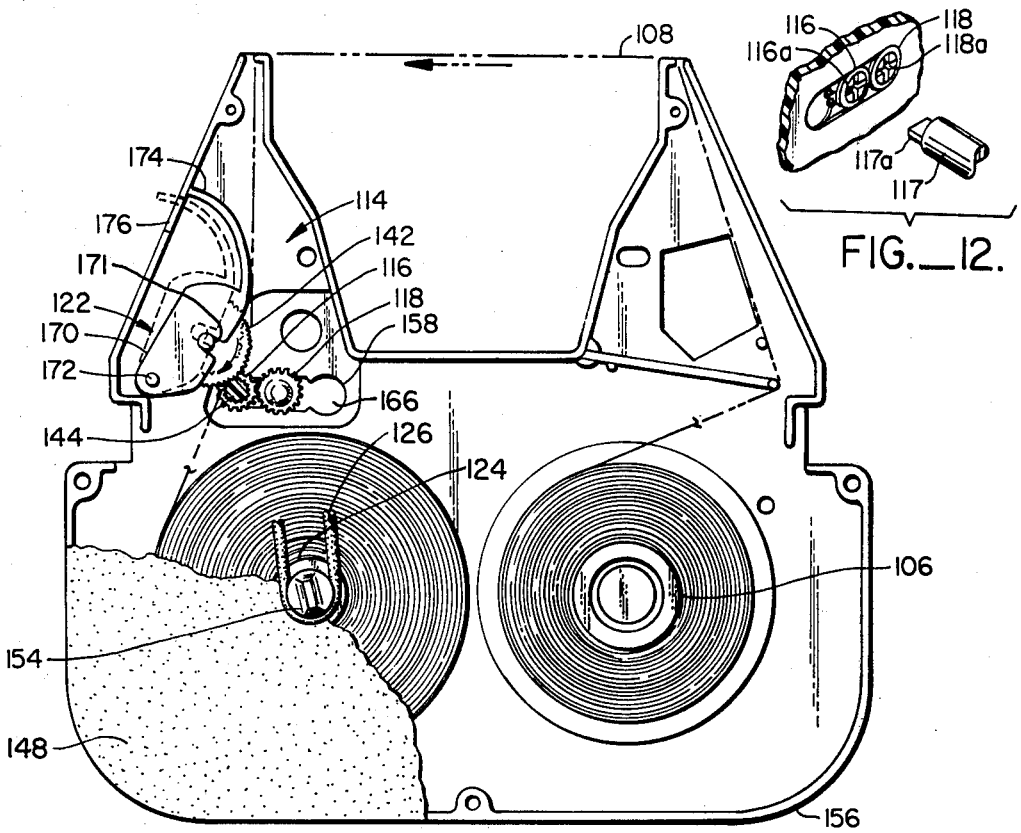
FIG._12.
FIG._8.
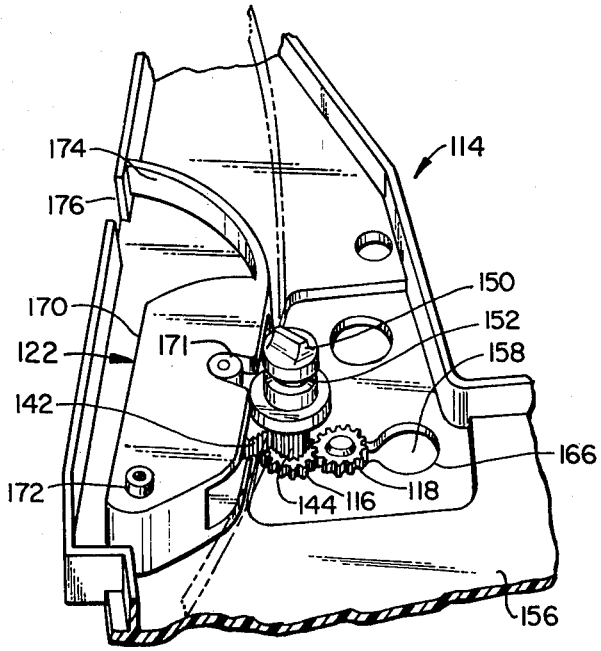
FIG._9.
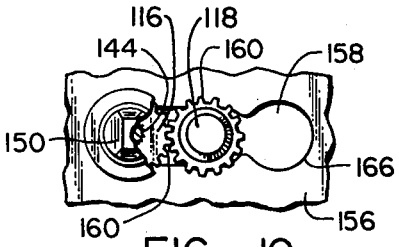
FIG._10.
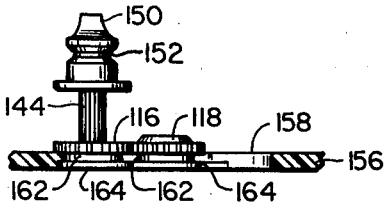
FIG._11.

UNIVERSAL RIBBON CARTRIDGE

This is a continuation-in-part of pending prior application Ser. No. 80,880 filed on Oct. 1, 1979, now U.S. Pat. No. 4,307,969, issued Dec. 29, 1981, of James R. Daughters for UNIVERSAL RIBBON CARTRIDGE.

This invention relates to a printer cartridge which can be adapted to differing machines wherein the printer cartridge is held at differing locations and provided with a drive for ribbon take-up at varied locations and rotating in opposite directions.

SUMMARY OF THE PRIOR ART

High speed printers of the daisy wheel type are known. In such printers a wheel with a protruding group of petals—typically one for each character—is provided. While operating at speeds well beyond human visual discrimination, the printer sequentially registers a wheel petal with a character to be printed thereon over a position on a piece of paper. Once registered, a hammer strikes a petal. Upon striking, the petal moves forward onto the ribbon, leaving an indicia of the desired letter on the paper to be printed.

These daisy wheel type printers commonly employ ribbon cartridges in their design. Such ribbon cartridges have a supply spool with a supply of fresh ribbon on it. They also have a take-up spool for winding the used ribbon around. The cartridge has two arms. The ends of the arms define a path along which the ribbon passes as it is wound onto the take-up spool. A drive shaft from the printer engages the bottom portion of a drive gear. The drive gear has a complementarily-shaped recess for engagement with the driving head of the drive shaft. The drive gear rotates a typically serrated drive wheel. The ribbon passes between the drive wheel and a biased idler wheel and is thereby advanced along the path between the daisy wheel printer and the paper. The take-up spool is typically rotated by an external drive band, such band being driven by an extension of the drive wheel.

Such printers, while having common printing mechanisms, have surprisingly varied mechanisms for holding the cartridge in place and driving the ribbon. For example, in one common type of cartridge, the cartridge is grasped at the sides with pegs registered to apertures in the printer. Exemplary of such a cartridge are those cartridges which fit the printer known as the Diablo II, a product of the Diablo Systems Division of the Xerox Corporation.

Another type of printer includes a mechanism whereby a second type of cartridge is grasped between the extended tape exit and tape entrance arms.

In both of the above type cartridges, driving is provided by driving shafts having driving heads which protrude into the cartridge at differing locations. Moreover, the driving shaft turns in a first direction in one printer and a second direction in the other printer.

It will be remembered that the cartridges are of the replaceable variety. They are typically consumed at the rate of one cartridge per working shift. This being the case, the cartridges are consumed on a volume basis.

Even though the printers and printer applications are highly similar, supplies of such ribbons must provide different cartridges for different machines. Inventory problems can result because of the number of types of cartridges which must be supplied. Moreover, confusion as to the required supply of each type may also arise.

SUMMARY OF THE INVENTION

A cartridge for accommodating a daisy wheel type printer is disclosed. The cartridge is the type which contains two spools. One spool (the supply spool) has wound about it a fresh supply of typing or printing ribbon. The other spool (the take-up spool) is used to wrap the used ribbon on. The cartridge has paired extending arms, including a ribbon exit on one arm and a ribbon entry on the other arm. These arms define a path for the ribbon to pass therealong. Along such path the ribbon stands between the paper and the printer mechanism, which is typically of the daisy wheel type. In the disclosed invention, two drive gears are serially engaged with each other and the ribbon drive means. When the first drive wheel is driven by the printer, the second acts as an idler gear so that the ribbon drive means rotates in the same direction as the drive shaft of the printer. When the second gear is driven, the ribbon drive means is driven directly so that the drive means rotates in the opposite direction as the drive shaft of the printer. The drive gears are located and their lower portions are configured to engage the respective drive shafts of various printers. The cartridge can accomodate drive shafts which rotate in opposite directions because of their serial engagement. Ribbon take-up can thus occur between varied drives having drive locations of varying spatial location as well as direction of rotation. Provision is made to gather the ribbon between an engaged ribbon drive wheel and an idler wheel to the take-up spool. Improved bias of the idler wheel against the drive wheel for ribbon engagement, resulting in improved assembly of the cartridge, is provided.

OTHER OBJECTS, FEATURES AND ADVANTAGES

An object of this invention is to disclose a cartridge which can be driven from more than one drive gear location by gears rotating in opposite directions. According to this aspect, a tape drive wheel is engageable with a biased idler wheel with the tape passing therebetween, preferably near the tape entrance arm of the cartridge. The drive wheel is driven by first and second gears, which first and second gears are in series. These respective first and second gears, because of their series alignment, rotate with the first gear rotating in one direction and the second gear rotating in the opposite direction. By placing the gears to overlay the respective drive shafts of differing printers, and by configuring the lower portion of the drive gears for rotational engagement with the corresponding drive shafts, one cartridge can accommodate drives from printers having drive shafts which rotate in opposite directions.

An advantage of this aspect of the invention is that a single cartridge can now be adapted for the first time to two different printers.

A further advantage of this invention is that even though the drive shafts of printers rotate in different directions, their respective opposite direction drives can be used to obtain ribbon passage in the same direction.

A further aspect of this invention is that a periphery of the tape cartridge can be adapted for mounting on various types of printers.

Yet another object of this invention is to disclose an improved biasing of the idler wheel against the drive wheel. According to this aspect of the invention, the idler wheel is mounted on an idler wheel carrying arm, which arm is pivotally mounted on a post. A generally flat spring extends outwardly from the carrying arm in registry with an aperture in the exterior of the cartridge. The unit is typically assembled with the flat spring protruding outwardly and through the aperture in the side. When the unit is assembled, an object such as a screwdriver or the like pushes the protruding end of the spring back through the aperture and to a flexed position in the interior of the cartridge. Forces which bias the idler wheel to the drive wheel thus exist only which bias the idler wheel to the drive wheel thus exist only after the cartridge is fully assembled.

The lack of biasing forces on the components before assembly reduces the tendency of support components, such as the spindle on which the drive wheel is supported, to be pushed out of their normal vertical alignment. This greatly facilitates assembly.

Additional objects and features of the invention will appear from the following description in which the preferred embodiment has been set forth in detail in conjunction with the accompanying drawing.

BRIEF DESCRIPTION OF THE DRAWING

FIG. 8 is a top view of an alternate embodiment of the invention with the top half of the body partly broken away.

FIG. 9 is a detailed view of the ribbon gathering means of the embodiment of FIG. 8.

FIG. 10 is a view of the first and second drive gears, with portions broken away.

FIG. 11 is a cross-sectional view of the first and second drive gears shown in FIG. 10.

FIG. 12 is a detailed view of the first and second drive gears of the embodiment of FIG. 8 illustrating the manner of engagement with a first printer drive shaft.

DETAILED DESCRIPTION OF THE PREFERRED EMBODIMENT

Figure 1:
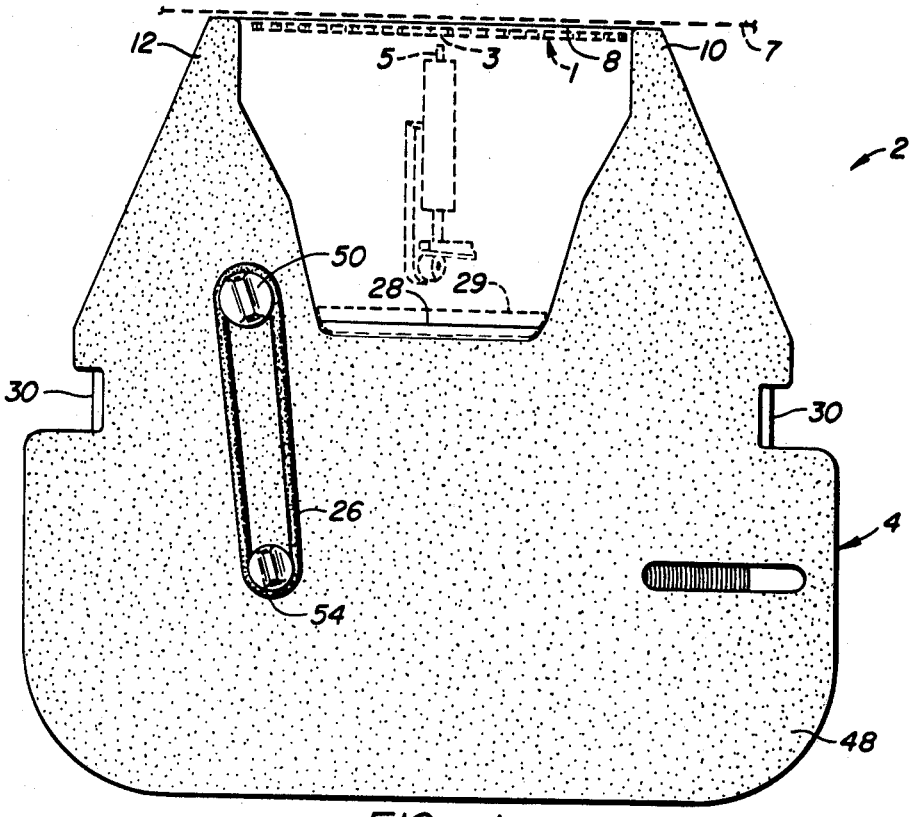
FIG. 1 is a top or plan view of the invention will a daisy wheel printer schematically shown.

A typical daisy wheel printer, the type with which the invention is generally used, will be described first to enable the reader to better understand the invention. Turning now to FIG. 1, universal ribbon cartridge 2 is shown together with a daisy wheel 1, a petal 3, a hammer 5, and paper 7. Daisy wheel 1, a thin, radially segmented disk-shaped element, carries the characters to be printed on the outermost ends of petals 3 of daisy wheel 1. When a character impression is to be imparted to the paper 7, daisy wheel 1 is rotatably indexed at a high rate of speed. Hammer 5 is then activated and strikes the proper petal 3 of daisy wheel 1. The struck petal 3 is driven forward against a ribbon 8 to leave its particular impression on paper 7. The entire printing mechanism including cartridge 2 (and ribbon 8 therewith), wheel 1 and hammer 5 are then indexed for the next impression. Additionally, ribbon 8 is indexed to provide fresh ribbon 8 for the next impression.

Figure 2:
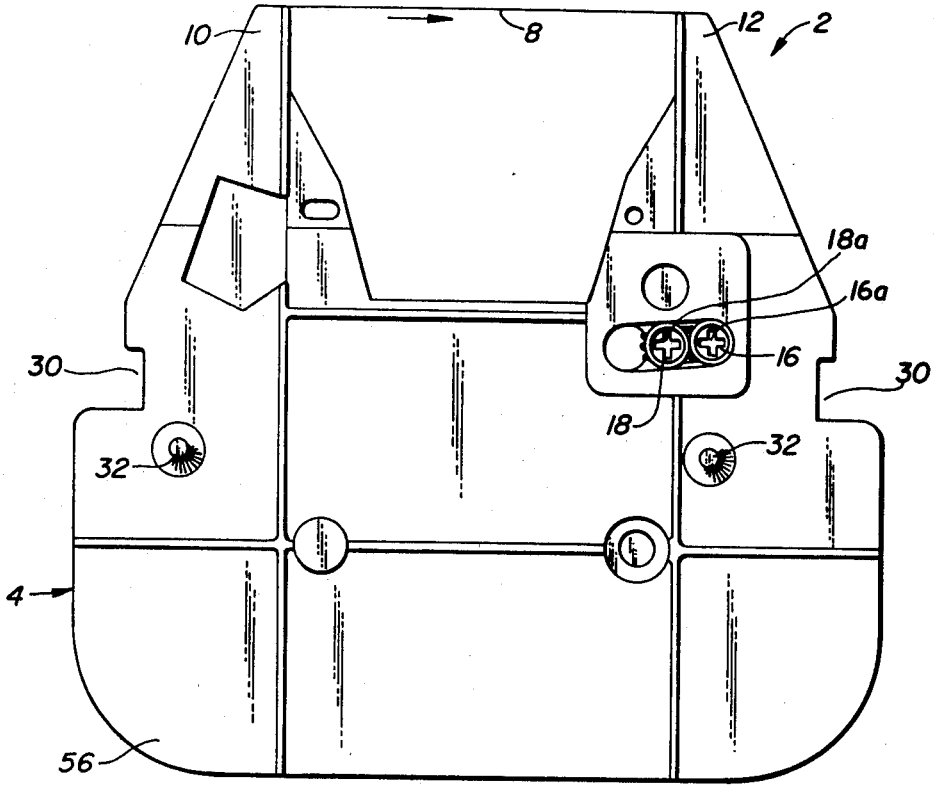
FIG. 2 is a bottom view of the invention.
Figure 3:
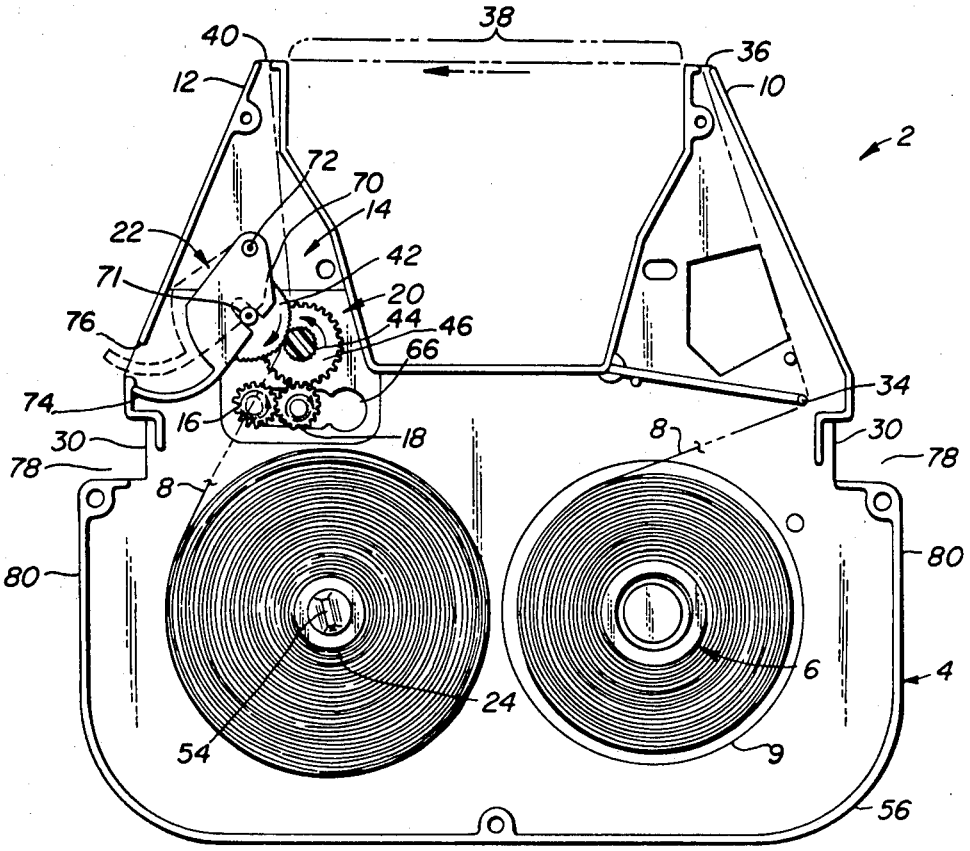
FIG. 3 is a top view of the invention with the top half of the body removed.

As can be seen from FIGS. 1–3, the universal ribbon cartridge 2 has a body 4, a supply spool 6 on which the ribbon 8 is wound, a ribbon exit arm 10, a ribbon entry arm 12, and a ribbon take-up means 14. Take-up means 14 includes first and second drive gears 16, 18, a ribbon drive means 20, an idler wheel assembly 22, a take-up spool 24 and an external drive band 26. A gripping surface 28, a mounting means 30, and removable pegs 32 allow the cartridge 2 to be mounted on different printers. FIG. 1 shows the gripping means 29 of the printer engaging surface 28 thereby securing cartridge 2 to the printer.

Turning to FIG. 3, supply spool 6 is mounted on body 4. Typically a piece of foam 9 is placed between supply spool 6 and body 4 to provide a drag on spool 6 so a proper tension is maintained on ribbon 8. Ribbon 8 wends its way past a first point 34 and then through an exit opening 36 at the end of exit arm 10. Ribbon 8 passes along a path 38 defined between exit and entry arms 10, 12 and re-enters body 4 through an entrance opening 40 formed at the end of entrance arm 12.

Figure 4:
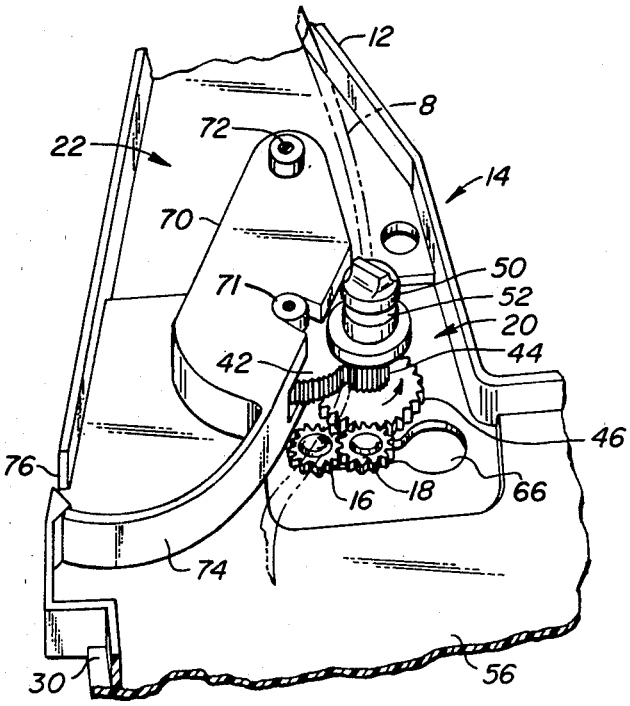
FIG. 4 is a detailed view of the ribbon gathering means and the first and second drive gears.

As shown best at FIG. 4 in conjunction with FIGS. 1 and 3, ribbon 8 is driven along its path by passing between the serrated surfaces of idler wheel 42 and ribbon drive wheel 44. Wheel 44 is mounted on a common shaft with a ribbon drive gear 46. Ribbon drive wheel 44 and ribbon drive gear 46 comprise ribbon drive means 20. Gear 46 rotatably engages and is driven by second drive gear 18.

Also mounted on the common shaft with ribbon drive gear 46 and extending outwardly past a top half 48 of body 4 is an extension 50 defining a circular groove 52 into which drive band 26 is seated. Band 26 also seats within a like groove in extension 54 extending from take-up spool 24. Rotation of drive wheel 44 thus results in the rotation of spool 24. As the amount of ribbon 8 on spool 24 increases, band 26 slips so that the travel of ribbon 8 along path 38 is determined by the rotational speed of serrated wheel 44 and not by the rotational speed of take-up spool 24.

Figure 5:
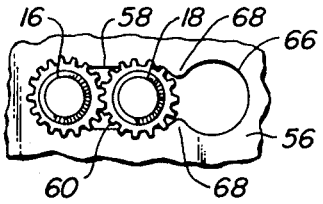
FIG. 5 is a view of the first and second driving gears mounted within an elongate hole in the bottom half of the body as seen from the inside of the cartridge.
Figure 13:
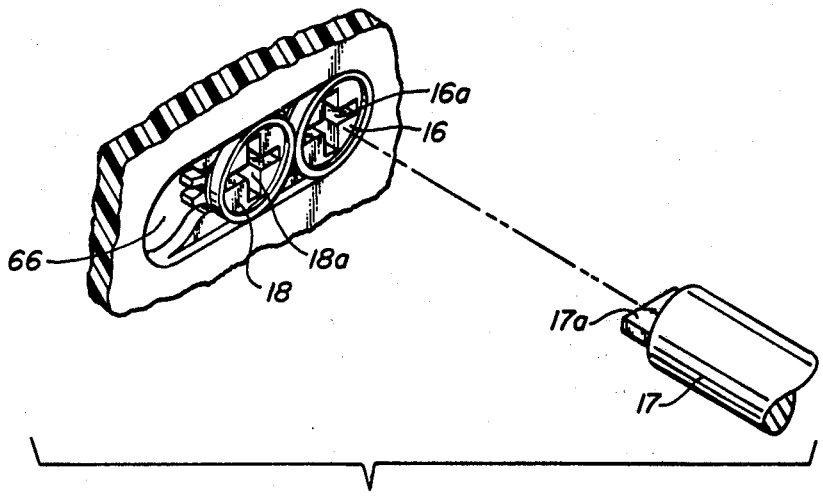
FIG. 13 is a detailed view of the first and second drive gears of the embodiment of FIG. 1 illustrating the manner of engagement with a first printer drive shaft.
Figure 14:
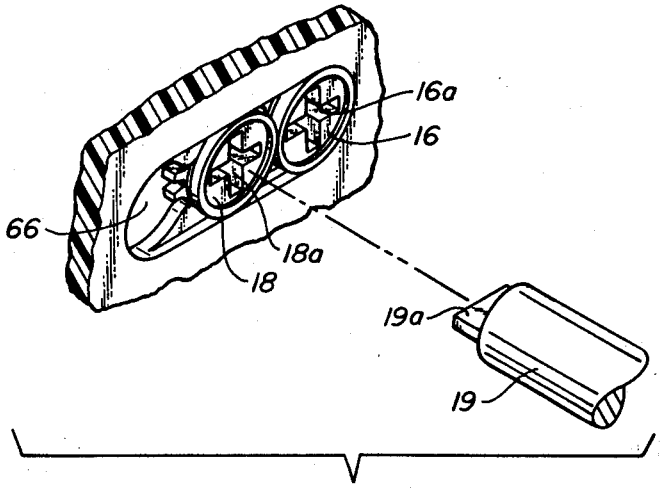
FIG. 14 is a view similar to FIG. 12 except it illustrates the engagement with a second drive shaft offset from the first drive shaft.

As seen best at FIGS. 2, 4 and 5, first and second drive gears 16, 18 are mounted in a bottom half 56 of body 4 with second gear 18 serially engaging both first gear 16 and drive gear 46. Gears 16, 18 are located to overlay respective ribbon drive shafts 17, 19 from differing types of printers. Gears 16, 18 have complementarily-shaped recesses **16*a*, 18*a*, respectively, for positive rotational engagement with their respective ribbon drive shafts 17, 19. A typical such ribbon drive shaft 17 is illustrated in FIG. 13. A drive head 17*a* projects from the distal end of the drive shaft 17 and engages the recess 16*a* of the first gear 16 when the cartridge 2 is inserted. In different model printers, the drive shaft is located in a different position, as shown in FIG. 14, where a drive shaft 19 having a drive head 19*a* engages the recess 18*a* of the second drive gear 18. In the preferred embodiment gears 16 and 18 are of the same size; however, depending upon the particular requirements of the printer used, gears 16, 18 may be of differing sizes. Also, in the preferred embodiment the serial alignment of gears 16, 18 allows the universal ribbon cartridge 2 to be used on printers with printer drives which rotate in opposite directions. This advantage exists because when first drive gear 16 is driven by the drive head 17***a* of the the printer drive shaft 17, second drive gear 18 acts as a direction reverser so that ribbon drive gear 46 turns in the same direction as the printer drive shaft 17. When the drive head 19*a* of the printer drive shaft 19 engages and drives the second drive gear 18, ribbon drive gear 46 turns in the opposite direction as the printer drive shaft 19.

Figure 6:
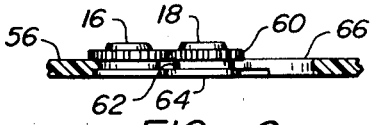
FIG. 6 is a cross-sectional view of the first and second driving gears shown in FIG. 5.

Turning now to FIGS. 5 and 6, drive gears 16, 18 are mounted on bottom half 56 in a conventional manner. An elongate hole 58 having semi-circular ends is formed in bottom half 56. Gears 16, 18 are relatively thin, cylindrical elements having teeth 60 around the circumference of one end, a groove 62 defined medially within the circumference of gears 16, 18, and a retaining shoulder 64 defining the circumference of the other end. The entry end 66 of hole 58 is slightly larger than the remaining portion thereby allowing shoulder 64 to be passed therethrough but not so large as to allow teeth 60 to pass therethrough. Gear 16 is then slid along hole 58 past detents 68. Gear 18 is likewise positioned in hole 58 and engages gear 16. Some slight pressure is necessary to get gears 16, 18 past detents 68. Gears 16, 18 are retained in position by the engagement of the sides of hole 58 with groove 62 and by detents 68.

Idler wheel assembly 22, as shown at in FIGS. 3 and 4, includes an idler wheel carrying arm 70 pivotally connected to body 4 at a pivot point 72 at one end thereof. Idler wheel 42 is rotatably connected to arm 70 on pin 71. At the end opposite pivot point 72, arm 70 includes a flat spring 74 extending outwardly therefrom. Spring 74 is configured to rest against an inside surface of body 4 at a point near an aperture 76 thereby biasing idler wheel 42 against ribbon drive wheel 44. During assembly spring 74 extends through aperture 76 so that no force is exerted by idler wheel 42 on ribbon drive wheel 44, as shown in phantom in FIG. 3. After assembly with top and bottom halves 48, 56 of body 4 secured, spring 74 is urged inwardly through aperture 76, thus biasing idler wheel 42 against ribbon drive wheel 44. Using this method, lateral forces on pivot point 72 and ribbon drive wheel 44 and gear, 46 are greatly reduced thus promoting alignment of components and easing assembly considerably.

Figure 7:
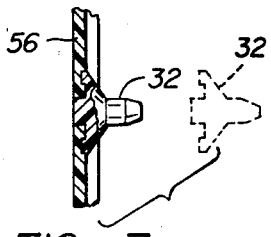
FIG. 7 is a cross-sectional view of a removable peg with the removed peg shown in phantom.

The preferred embodiment of universal ribbon cartridge 2 is adapted for mounting on at least two types or classes of printers. A first type engages cartridge 2 at gripping surface 28, shown at FIG. 1, which surface is defined along the edge of top half 48 of body 4 between arms 10, 12. A second type grips bottom half 56 at gripping means 30, shown at FIG. 3. Means 30 is a narrow planar extension located within a notch 78 medially along both sides 80. Cartridge 2 also has removable pegs 32, as seen at FIGS. 2 and 7, positioned within bottom half 56 for registry with corresponding apertures (not shown) in the second type printer. The phantom view in FIG. 7 illustrates the peg 32 removed from the bottom half 56 of the cartridge 2. Such removal is within the skill of the art. Typically the peg 32 will be secured to the bottom half 56 by a screwed connection. Other means, such as pivotable pegs, not shown, could also be used in lieu of the removable pegs 32.

In the preferred embodiment all elements, except drive band 26 and ribbon 8, are made of plastic, however other suitable materials can be used. Spring 74 could, for example, be made of phosphor bronze as well as nylon.

An alternate embodiment of the present invention is illustrated in FIGS. 8–12. A take-up means 114 illustrated therein is similar to the take-up means 14 described hereinbefore except that the ribbon drive means 20 has been eliminated and mounting of the idler wheel assembly 22 has been reversed. Note that the final two digits of the reference numerals used in FIGS. 8–12 correspond to the reference numerals used for similar elements illustrated in FIGS. 1–7.

The operation of the alternate embodiment of the universal ribbon cartridge is very similar to that of the first embodiment described hereinbefore. A ribbon 108 is fed from a supply spool 106 to a take-up spool 124. The shape of the cartridge is identical as is the manner of mounting in the printer. Only the arrangement of the take-up means 114 differs and only that arrangement will be described.

The take-up means 114 includes a first drive gear 116, a second drive gear 118, and an idler wheel assembly 122. The ribbon 108 is driven along its path by passing between the serrated surfaces of an idler wheel 142 and a ribbon drive wheel 144. Ribbon drive wheel 144 is mounted on a common shaft with the first drive gear 116.

Also mounted on the common shaft with first drive gear 116 and extending outwardly past a top half 148 of the cartridge is an extension 150 having a circular groove 152 into which a drive band 126 is seated. It will be appreciated that said drive band 126 operably connects the extension 150 to a similar extension 154 on the take-up spool 124. In this manner the take-up spool 124 is rotated whenever the first drive gear 116 is rotated. As the amount of ribbon 108 on spool 124 increases, band 126 slips so that the travel of ribbon 108 is determined by the rotational speed of the serrated wheel 144 and not by the rotational speed of take-up spool 124.

As seen best in FIGS. 9 through 11, the first and second drive gears 116, 118 are mounted in a bottom half 156 of the cartridge, with the first gear 116 engaging the second gear 118. Drive gears 116 and 118 are located to overlay ribbon drive shafts on different model printers. The arrangement of the ribbon drive shaft is the same as was described in connection with the first embodiment for drive shafts 17 and 19, respectively. Gears 116 and 118 have complementary-shaped recesses 116*a* and 118*a*, respectively, for positive rotational engagement with a drive head on the ribbon drive shaft. FIG. 12 illustrates the case of the first type of printer having a ribbon drive shaft 117 and a drive head 117*a* which are located, when the cartridge 2 is inserted therein, so that the drive head 117*a* engages the recess 116*a*on the first drive gear 116. In the second type of printer, the drive shaft 117 is offset somewhat so that the drive head 117*a* engages recess 118*a* on the second drive gear 118. As illustrated in FIGS. 8–12, gears 116 and 118 are of the same size; however, depending on the particular requirements of the printer used, gears 116 and 118 may be of differing sizes.

The presence of gears 116 and 118 allows the alternate embodiment of the universal ribbon cartridge to be used on printers with printer drives which rotate in opposite directions. This advantage exists because when the second gear 118 is driven by the driving head 117*a* of the ribbon drive shaft 117 the first drive gear 116 acts as a direction reverser so that first drive gear 116 turns in the opposite direction from the direction of rotation of the ribbon drive shaft 117. When the first drive gear 116 is driven by the ribbon drive shaft 117 directly, the first drive gear 116 turns in the same direction as the ribbon drive shaft 117.

Referring again to FIGS. 10 and 11, drive gears 116 and 118 are mounted in an elongate hole 158 having semicircular ends. Gears 116 and 118 are relatively thin cylindrical elements having teeth 160 around the circumference of one end, a groove 162 defined medially within the circumference of gears 116 and 118 and a retaining shoulder 164 defining the circumference of the other end. The entry end 166 of hole 158 is slightly larger than the remaining portion thereby allowing shoulder 164 to be passed therethrough but not so large as to allow teeth 160 to pass therethrough. Removal of the gears 116 and 118 is similar to that described in connection with the earlier embodiment.

Idler wheel assembly 122 as shown in FIG. 9 includes an idler wheel carrying arm 170 pivotally connected to the lower half 156 at a pivot point 172 at one end thereof. Idler wheel 142 is rotatably connected to arm 170 by a pin 171 at the end opposite pivot point 172. The arm 170 includes a flat spring 174 extending outwardly therefrom. Spring 174 is arranged to rest against an inside surface of the lower half 156 at a point near an aperture 176 thereby biasing idler wheel 142 against ribbon drive wheel 144. During assembly, spring 174 extends through aperture 176 (as shown in phantom in FIG. 8) so that no force is exerted by idler wheel 142 on ribbon drive wheel 144. After assembly of the cartridge spring 174 is urged inwardly through aperture 176 thus biasing idler wheel 142 against ribbon drive wheel 144. Using this method lateral forces on pivot point 172 and ribbon drive wheel and gear 144, 146 are greatly reduced thus promoting alignment of components and easing assembly considerably.

Thus, although the best modes contemplated for carrying out the present invention have been herein shown and described, it will be apparent that modification and variation may be made without departing from what is regarded to be the subject of the invention.

I claim:

1. In a ribbon cartridge for use in at least two types of printers, said printers having a drive shaft with a driving head formed at the outer end thereof for driving engagement with a drive gear of a cartridge, one type of printer having a drive shaft in a first location and the other type of printer having a drive shaft in a second location, the ribbon cartridge including a body having a ribbon exit arm and a ribbon entry arm, said arms defining a path for the passage of ribbon between the exit and entry arms, the ribbon in the cartridge passing from a supply spool, housed within the body, out through the exit arm, past the printer, and in through the entry arm, the improvement in said cartridge comprising:

a first drive gear mounted on the body at a first location;

a second drive gear mounted on the body at a second location and situated for rotatable engagement with said first drive gear;

said first and second drive gears defining recesses within the outer surfaces thereof, said recesses shaped for driven engagement with said driving head;

a ribbon drive gear mounted coaxially on the first drive gear and projecting into the interior of the cartridge;

an idler wheel rotatably mounted on the body and located adjacent the ribbon drive gear so that the idler wheel and ribbon drive gear coact to advance the ribbon as either the first drive gear or second drive gear is rotated; and a take-up spool mounted on the body and rotatably coupled to the drive gears so that said advanced ribbon is collected on said take-up spool.

2. The device of claim 1 further comprising:

an idler wheel assembly comprising an idler wheel carrying arm which has the idler wheel rotatably mounted thereon, said carrying arm being pivotally mounted on said body at one end of said arm and having a spring at the other end of said arm which biases the carrying arm and idler wheel therewith inwardly for rotational engagement of the idler wheel with the ribbon drive gear, whereby the ribbon passing between the engaged idler wheel and ribbon drive gear is advanced by rotation of either the first drive gear or the second drive gear.

3. The device of claim 2 wherein said body has an aperture formed therein so that the free end of said spring may extend therethrough in an unstressed condition and said spring may be urged inwardly to a stressed condition thereby biasing the carrying arm and idler wheel therewith inwardly for said rotational engagement of said idler wheel with said ribbon drive gear.

4. A ribbon cartridge for use on more than one type of printer, each printer including a drive shaft with a driving head at the end thereof, the driving heads of the printers located in different positions and rotating in different directions, comprising:

a body;

a supply spool having a supply of ribbon mounted within the body;

said body having a ribbon exit arm and a ribbon entrance arm, said arms defining a path therebetween for passage of said ribbon from said supply spool, out through the exit arm, along said path, and in through the entrance arm;

a take-up spool for gathering the ribbon as said ribbon passes in through the entrance arm;

a first drive gear mounted in the body in a first position;

a second body gear mounted in the body in a second position, said second gear rotatably engaged with said first drive gear so that said first drive gear rotates in a first direction while said second drive gear rotates in a second direction;

a ribbon drive gear mounted coaxially on the first drive gear and projecting into the interior and located generally between the entrance arm and the take-up spool;

an idler wheel rotatably mounted on the body and located adjacent the ribbon drive gear so that the idler wheel biases the ribbon against the ribbon drive gear whereby the ribbon is advanced by the rotation of the ribbon drive gear;

said first and second drive gears arranged and located for driven engagement with the driving head of a printer whereby said cartridge is adaptable for use with printers having different driving head locations and different directions of driving rotation; and means for coupling the take-up spool to the drive gears so that the take-up spool is positively rotated to collect the ribbon as the ribbon is advanced.

5. The device of claim 4 wherein the printer drives the first drive gear.

6. The device of claim 4 wherein the printer drives the second drive gear.

7. The device of claim 4, further comprising means for resiliently mounting the idler wheel to apply a predetermined biasing force against the ribbon drive gear.

8. The device of claim 7, wherein the resilient mounting means comprises an arm for carrying the idler wheel, said arm being pivotally attached to the body, and a spring for biasing the arm toward the ribbon drive gear.

* * * * *